United States Patent [19]

Beveridge et al.

[11] 4,048,935

[45] Sept. 20, 1977

[54] CONTAINER AND METHOD OF FORMING SAME

[75] Inventors: John Beveridge, Uxbridge; Thomas Roderick Harries Davies, Pinner; Fred Fidler, Cuffley; Maurice Frank Ring, Epsom, all of England

[73] Assignee: Metal Box Limited, England

[21] Appl. No.: 736,817

[22] Filed: Oct. 29, 1976

Related U.S. Application Data

[62] Division of Ser. No. 523,928, Nov. 14, 1974, Pat. No. 4,003,492.

[51] Int. Cl.[2] ..... B21D 51/28

[52] U.S. Cl. ..... 113/120 F; 113/120 K

[58] Field of Search ..... 113/8, 12, 120 A, 120 F, 113/120 K; 220/81 R, 62, 75, 76

[56] References Cited

U.S. PATENT DOCUMENTS

| | | | |
|---|---|---|---|
| 699,592 | 5/1902 | Thompson | 220/81 R |
| 2,346,619 | 4/1944 | Schrader | 113/120 K |
| 2,730,983 | 1/1956 | Campbell et al. | 113/120 F |
| 2,801,648 | 8/1957 | Anderson et al. | 113/120 F |
| 2,876,725 | 3/1959 | Buck et al. | 113/120 F |
| 2,967,161 | 1/1961 | Hart | 220/81 R |
| 3,125,056 | 3/1964 | Kaiser | 113/120 F |
| 3,314,388 | 4/1967 | Davis et al. | 113/120 K |
| 3,550,806 | 12/1970 | Peerman et al. | 220/81 R |

*Primary Examiner*—Michael J. Keenan

*Attorney, Agent, or Firm*—Diller, Brown, Ramik & Wight

[57] ABSTRACT

This disclosure relates to a container body side seam construction wherein a metal body blank is provided with adhesive strips along opposite edges thereof, followed by the forming of hooks at such opposite edges. Thereafter, the body blank is formed in a conventional body-making machine so as to first interlock the hooks and then, while the hooks are engaged, flattening the hooks to form an interlocked side seam wherein the adhesive strips are in tightly clamped relation with respect to one another and portions of the side seam. While the adhesive strips are so held, the side seam is heated so as to effect bonding of the adhesive strips. The principal advantage of the container body side seam construction is that no external means is required to hold the side seam portions in their proper positions while the adhesive strips are being heated and then permitted to set.

8 Claims, 6 Drawing Figures

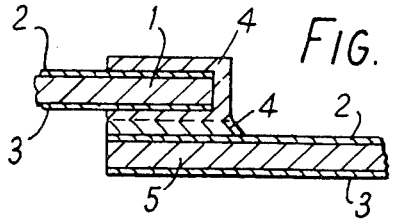
FIG. 1 (PRIOR ART)
FIG. 2
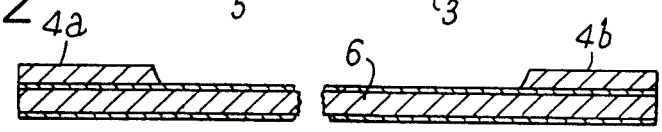
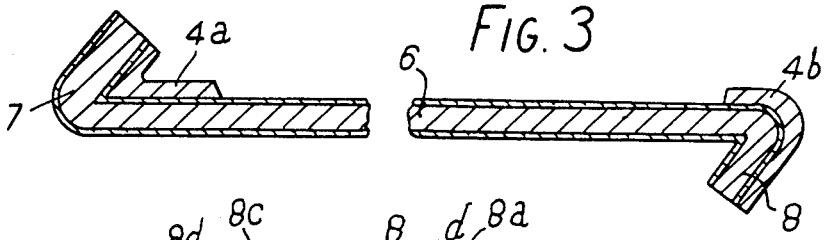
FIG. 3
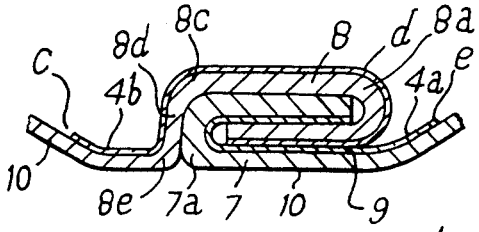
FIG. 4
FIG. 5
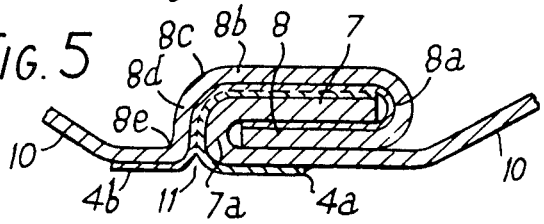
FIG. 6
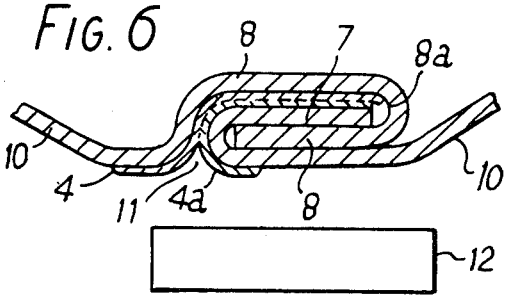

CONTAINER AND METHOD OF FORMING SAME

This is a division of Application Ser. No. 523,928, filed Nov. 14, 1974 now U.S. Pat. No. 4,003,492, granted Jan. 18, 1977.

This invention relates in general to containers and more particularly to metal containers having interlocking side seams and to methods for forming such side seams.

Cans and like containers having locked side seams are well known and where seams of improved gas or liquid holding ability are needed, these side seams are treated with adhesives or solders. When solders are used, the cans are usually heated, and the solder is drawn into the interlocking side seams by capillary attraction. When organic materials, known as side seam cements, are used, they are usually applied to the body hooks prior to body-forming and are expected to flow. There is a further type of side seam in which the body material overlaps to form a lap joint with the bond between the lapping portions of the joint having been made by means of solder or by means of organic resinous adhesives such as nylon applied in the form of tape. It is to be understood that when the side seam is in the form of a lap joint, the overlapping edges of the body blank must be mechanically held in place until the bonding of the lapped portions has been completed. This presents particular difficulities and time delays when the bonding means is an organic resinous adhesive.

According to the present invention, it is proposed to bond the side seam by means of an organic resinous material but to form the side seam as a lock seam wherein the interlocked parts of the body blank firmly hold themselves together until such time as the organic resinous material can be heated and flowed to form the necessary bond.

In a method of manufacturing an interlocking side seam of a container in accordance with this invention, an organic resinous material in the form of tape is applied to the seam margins of a container body blank, which is then passed through a known lock seam bodymaker in which the seam margins are folded to form body hooks and the blank is then formed around a mandrel to engage the hooks with each other to form a seam which is next hammered flat. The resultant container body is then passed over heaters so that the side seam is raised to a temperature at which the organic resin tape layers can fuse to each other and bond to the adjacent metal to improve the integrity of the side seam.

An advantage of this invention is that the lock seam supports the adhesive during the prolonged setting times needed and allows ordinary body-makers to be used.

In a preferred embodiment of the invention, the two tape margins are both disposed on the same side of the body blank so that when the container body is formed and resin fusion has been crried out, a continuous layer of organic resin material covers the side seam and bridges from one side of the side seam to the other.

With the above and other objects in view that will hereinafter appear, the nature of the invention will be more clearly understood by reference to the following detailed description, the appended claims and the several views illustrated in the accompanying drawings:

IN THE DRAWINGS:

FIG. 1 is a cross sectional view of a lap joint formed in accordance with the prior art.

FIG. 2 is a cross sectional view of a container body blank, shown diagrammatically, in which the organic resinous material is placed at each end of the body blank on one side thereof.

FIG. 3 is a sectional view of the body blank of FIG. 2, but after body hooks have been formed thereon.

FIG. 4 is a fragmentary sectional view through the seam of a container body formed with the body blank of FIG. 2.

FIG. 5 is another fragmentary sectional view of a side seam showing an alternative adhesive placement.

FIG. 6 is still another fragmentary sectional view of a side seam showing a further form of adhesive placement.

Referring now to the drawings, it will be seen that there is illustrated in FIG. 1 a known form of container side seam. The container is formed from a body blank 1 which is coated with a lacquer coating 2 on the inside surface thereof and another coating material 3 on the outside surface thereof. Organic resinous joint material 4 is applied to a margin parallel to one edge of the body blank 1 and like material is applied to the other joint margin 5. The two margins are brought into overlapping relation and are heated at 180° C. for up to 1 minute during which time the organic resinous material fuses, forming a joint such that the organic material not only provides adhesive qualities, but also corrosion protection on the inside of the container In this method adhesives which do not flow freely can be used, although the time required for forming the bonded side seam is comparatively long with respect to other methods of forming container body side seams.

In FIG. 2 there is shown a generally rectangular flat body blank 6 which, like the body blank 1, has the inner surface thereof coated with a lacquer coating 2 and the outer surface thereof coated with another coating material 3. An organic resinuous joint material is applied to two parallel strips **4*a* and 4*b* at the respective opposite ends of the body blank 6** and on the same side of the blank.

In FIG. 3 the body blank 6 is shown after body hooks 7 and 8 have been formed thereon with the strips **4*a* and 4*b* being shown in their bent configurations diagrammatically. In FIG. 4 there has been illustrated the side seam of a container formed utilizing the body blank 6 of FIG. 3 after the body hooks 7 and 8 have been engaged with one another and the resultant seam has been flattened in a conventional bodymaker. It is to be understood that the container body formed from the body blank 6** is generally cylindrical.

In order to more fully identify the portions of the side seam of FIG. 4, it is to be noted that the body hook 8 is the inside hook and is connected to the body wall 10 of the container body by means of an inside hook radius **8*a*, an inside hook panel 8*b*, an inside hook panel radius 8*c*, an inside hook panel step 8*d* and an inside hook panel step radius 8*e* in that sequence. Further, it is to be noted that the outside body hook 7 is connected to the body wall 10 by an outside hook radius 7*a*. It is further to be noted that the adhesive strip 4*a* overlies the inner surface of the outside hook, the outside hook radius and an adjacent portion of the body wall with one part of the strip 4*a* being disposed directly between the outside hook 7 and the inside hook 8**, and another portion of the strip 4*a* being disposed between the inside hook 8 and the adjacent part of the body wall 10. Further, it is to be noted that the strip 4*b* extends from the body wall 10 on the inner surface of the container body entirely over all portions of the inside hook and terminates in an end portion disposed between the inside hook and the adjacent portion of the body wall 10 and in face-to-face engagement with an adjacent portion of the strip 4*a*.

It is further to be understood that the side seam has all of the components thereof tightly clamped together during the flattening of the side seam with the result that there is pressure engagement on that portion of the strip 4*a* disposed between the inside hook 8 and the outside hook 7. There is like pressure engagement on those portions of the strips 4*a* and 4*b* disposed between the inside hook 8 and the adjacent portion of the body all 10 so that the strips 4*a* and 4*b* are held in place for bonding by the application of heat without the use of any external clamping mechanism.

It is also pointed out at this time that for purposes of clarity the lacquer coating 2 and the layer of coating material 3 have been omitted from FIGS. 4, 5 and 6. In practice, the lacquer coating 2 may not be needed, but if, for some reason, it is needed, care must be taken in its selection. For example, a particular epoxy-phenolic lacquer may be chosen.

Returning now to FIG. 4, it will be seen that the organic resinuous layers 4*a* and 4*b* meet at a point of juncture 9 between the inside hook 8 and the adjacent portion of the body wall 10 so that upon fusion of the strips 4*a* and 4*b*, along on interface or juncture a continuous layer of organic resinuous adhesive seals the side seam and covers the adjacent margins to protect the seam region from corrosive influence of any product contained in the resultant container. It is to be understood that normally there is an inner entrance slot into the side seam from the interior at the point of juncture 9 between the adhesive strips 4*a*, 4*b* and this entrance slot is sealed by the bonding together of adhesive strips 4*a*, 4*b*. The adhesive strips 4*a*, 4*b* extend from the entrance slit in diverging relation.

As shown in FIG. 4, the adhesive strips 4*a* and 4*b*, combined, extend entirely across the side seam from point *c* to point *e*, thus covering all the heavily worked portions of the side seam. However, if for reasons of economy it may be useful to terminate the strip 4*b* sooner, the strips 4*b* may be terminated at point *e* which is generally at the intersection of the inside hook radius 8*a* and the inside hook panel 8*b*.

Referring now to FIG. 5, it will be seen that there is illustrated a container side seam formed from the body blank 6 wherein the edge portions thereof are formed with hooks 7 and 8 in the same manner as shown in FIG. 3 and then formed into a seam in the same manner as described with respect to FIG. 4. However, the adhesive strips 4*a* and 4*b* are applied to the outer surface of the body blank 6 instead of the inner surface thereof, as shown in FIG. 2. In the side seam of FIG. 5, it will be seen that the adhesive strip 4*a* extends from the body wall 10 around the outside hook radius 7*a* and into the space between the outside hook 7 and the inside hook panel 8*b*. On the other hand, the adhesive strip 4*b* extends from the body wall 10 into the side seam in overlying relation to all portions of the inside hook with an intermediate portion of the adhesive strip *b* being clamped in face-to-face engagement with a portion of the strip 4*a* between the outside hook 7 and the inside hook panel 8*b*. Further, a portion of the adhesive strip 4*b* is clamped between the outside hook 7 and the inside hook 8.

In addition to forming a bonded interlock between the portions of the hooks 7 and 8, and forming a seal between the hooks 7 and 8, the strips 4*a*, 4*b* are joined together along an interface or juncture beginning at the outside entrance slot into the seam, identified by the numeral 11, and extend in opposite directions therefrom on the exterior surface of the body wall 10.

Referring now to FIG. 6, it will be seen that the placement of the adhesive strip 4*b* may be restricted, for the purposes of economy, or to specifically protect and adhere together only certain parts of the side seam. As shown in FIG. 6, the strip 4*b* terminates at the end of the inside hook panel 8*b* adjacent the inside hook radius 8*a*. The side seam of FIG. 6 is otherwise identical to the side seam of FIG. 5.

It is to be understood that after the side seams of FIGS. 4, 5 and 6 have been formed by a conventional body-maker, heat is applied to the side seam so as to effect fusing of the organic resinuous joint material of the adhesive strips 4*a*, 4*b*. This heat may be applied in any desired manner and the heater 12 is schematically illustrated to FIG. 6 for this purpose. It is to be understood that a like heater 12 may be utilized in conjunction with the side seams of FIGS. 4 and 5.

It has been found that a suitable organic resinuous adhesive which may be utilized for forming adhesive strips 4*a*, 4*b* and that marketed under the Trade Mark "Kuroplast 2306", which is a terpolymer of ethylene, acrylic acid and acrylic ester. This organic resinuous adhesive adheres well to tinplate and other container forming metals, and softens at 180° C, which is within the temperature range of current body-maker heaters, such as the heater 12; and stays in place without the risk of the adhesive material fouling the body-maker tooling. The body blank may be preheated so as to obtain initial bonding of the heated strips 4*a*, 4*b* to the body blank.

While the method of carrying out the invention, as hereinbefore described, starts with the use of adhesive strips 4*a*, 4*b* in the form of tape, it is quite possible to apply adhesive strips to the body blank in some other form such as an extrudate from a nozzle. In this case, the extrudate may have sufficient heat to promote adhesion without the body blank being preheated, although preheating of the body blank is not precluded.

It is also to be understood that the organic resinuous material of the strips 4*a*, 4*b* may, alternatively, be applied to the body blank as a powder. The powder may be applied to the body blank as a spray, with or without electrostatic directional control. If the powder is sprayed hot, then the body blank may not need preheating. If, however, the powder is sprayed cold, the body blank is preferably heated to encourage the organic resinuous material to adhere to the body blank.

Although only several preferred embodiments of the invention have been specifically illustrated and described herein, it is to be understood that minor variations may be made in the side seam construction and method of forming the same without departing from the spirit and scope of the invention, as defined by the appended claims.

We claim:

1. A method of forming a container body having a side seam of the hook type comprising the steps of providing a body blank having two opposite faces, forming the body blank to have hook portions along opposite edges of a main portion thereof with the hook portions having bonded thereto adhesive strips applied to a single face of said body blank and extending beyond the hook portions into the main portions, forming the body blank into tubular shape, interlocking the hooks, flattening the hook portions to form a side seam and to maintain the interlocked relationship of the hook portions and to clamp the adhesive strips in opposed contacting relation between the hook portions with parts of the adhesive strips extending out of the side seam to seal the usual entrance thereinto, and heat treating the adhesive strips to effect bonding of the adhesive strips to adjacent side seam portions while the flattened interlocked hook portions remain stationary and hold the side seam portion in fixed relation.

2. The method of claim 1 wherein the adhesive strips are applied to a width wherein in the side seam in addition to a first portion of one of the adhesive strips being clamped against the other adhesive strip a second portion of the one adhesive strip is clamped directly between two hook portions.

3. The method of claim 1 wherein the adhesive strips are applied to the body blank prior to the forming of the hook portions, the body blank is preheated to assure bonding of the adhesive strips thereto, and wherein in forming of the body blank the bonded adhesive strips are transversely bent.

4. The method of claim 3 wherein the body blank preheating is effected at the time of application of the adhesive strips to assure bonding of the adhesive strips thereto.

5. The method of claim 1 wherein the hook portions are disposed inwardly of the container body and the part of the adhesive strips extending out of the side seam extend into the interior of the container body.

6. The method of claim 5 wherein the hook portions are disposed inwardly of the container body and the part of the adhesive strips extending out of the side seam extend to the exterior of the container body.

7. The method of claim 2 wherein the hook portions are disposed inwardly of the container body and the part of the adhesive strips extending out of the side seam extend into the interior of the container body.

8. The method of claim 2 wherein the hook portions are disposed inwardly of the container body and the part of the adhesive strips extending out of the side seam extend to the exterior of the container body.

* * * * *